United States Patent [19]

Nakamura

[11] Patent Number: 4,741,140

[45] Date of Patent: May 3, 1988

[54] MASONRY WALL STRUCTURE

[76] Inventor: Moritoshi Nakamura, c/o Cosmo Real Estate Company, Limited, No. 4-10, 4-chome, Ginza, Chuo-ku, Tokyo, Japan

[21] Appl. No.: 66,955

[22] Filed: Jun. 29, 1987

[51] Int. Cl.[4] ..... E04B 2/00

[52] U.S. Cl. ..... 52/427; 52/431; 52/432; 52/565; 52/571; 52/572

[58] Field of Search ..... 52/220, 221, 415, 418, 52/419, 421, 424–427, 429, 430–432, 434, 437, 438, 442, 562–565, 569–572, 607, 608

[56] References Cited

U.S. PATENT DOCUMENTS

| | | | |
|---|---|---|---|
| 861,499 | 7/1907 | Carroll | 52/427 X |
| 898,656 | 9/1908 | Keagle | 52/571 |
| 1,086,016 | 2/1914 | Bolles | 52/608 |
| 1,334,672 | 3/1920 | Noullet | 52/425 X |
| 1,551,430 | 8/1925 | Reynolds | 52/427 |
| 2,602,322 | 7/1952 | Preble et al. | 52/438 X |
| 2,647,392 | 8/1953 | Wilson | 52/421 X |
| 2,940,295 | 6/1960 | Post | 52/432 X |
| 3,475,873 | 11/1969 | Steadman | 52/429 X |
| 4,577,447 | 3/1986 | Doran | 52/571 |

FOREIGN PATENT DOCUMENTS

| | | | |
|---|---|---|---|
| 517372 | 2/1953 | Belgium | 52/570 |

*Primary Examiner*—John E. Murtagh
*Assistant Examiner*—Andrew Joseph Rudy
*Attorney, Agent, or Firm*—Burns, Doane, Swecker & Mathis

[57] ABSTRACT

A masonry wall structure comprising hollow concrete block units laid in courses, wherein each of the block units comprises front and rear panel members and a pair of side panel assemblies which form a gap between adjacent two of the block units. The side panel assemblies are connected to the front and rear panel members by means of reinforcing bars projecting rearwardly and forwardly from the front and rear panel members, respectively, into the gaps on both sides of each block unit, connecting bars projecting forwardly and rearwardly from the side panel assemblies into the gaps, steel wires binding overlapping end portions of the reinforcing and connecting bars together, and a body of cementitious material such as mortar filling the gaps and having completely buried therein those end portions of the bars which are bound together by the steel wires.

5 Claims, 3 Drawing Sheets

MASONRY WALL STRUCTURE

FIELD OF THE INVENTION

The present invention relates to masonry wall structures for the construction and repair of roads, bridges, canals, harbors and railways, revetments and bankings, and interior retaining walls of cellars, basements, tunnels, subway tubes and other underground and subsurface-based buildings and facilities. More particularly, the present invention relates to a masonry wall structure composed of hollow, coursed and interlocked concrete block units for use as an earth control or building wall structure.

BACKGROUND OF THE INVENTION

In order to provide ease of masonry construction work at site and to reduce the period of time required for the construction work, a masonry wall structure composed of hollow concrete blocks is in wide use typically as a retaining wall which is a wall for sustaining the pressure of earth behind the wall structure. Among such hollow concrete blocks is known a built-up type reinforced-concrete block which is composed of initially separate component panels. The reinforced-concrete component panels for such a built-up masonry block unit are prefabricated as separate members and are combined together into hollow block form at the site of construction. Each of the component panels of the block units is thus provided with strips or bands of steel which are to be bolted to the steel strips or to bands of another panel. Large amounts of time and labor are required for the assembling of the block at the site of construction in addition to the considerable amount of costs for the purchase, or manufacture, of the steel bands, bolts and nuts per se which are used additionally to the ordinary reinforcing bars embedded in the panels. This significantly impairs the potential advantages of the hollow built-up concrete blocks which are easy to manufacture, transport and handle.

The concrete panels to be combined together by bolting the steel bands have another problem, which results from the fact that such panels must be formed with cutouts or recesses to provide spaces reserved for accommodating bolts and nuts where interlocking joints are to be formed between the panels. Provision of such cutouts or recesses significantly restricts the geometry and design considerations of the concrete panels so that panels with two different designs must be provided and used, the panels with one design being for one side of a block unit and the panels with the other design being for the other side of a block unit. This is objectionable from the view point of simplicity of construction of the block units and of increasing the working efficiency at the site of construction.

SUMMARY OF THE INVENTION

In accordance with the present invention, there is provided a masonry wall structure comprising a number of block units laid in courses each composed of a series of block units positioned laterally adjacent to one another, wherein each of the block units comprises (a) a front panel member of concrete, (b) a rear panel member of concrete rearwardly spaced apart substantially in parallel from the front panel member, (c) a pair of side panel assemblies spaced apart substantially in parallel from each other laterally of the block unit, one of the side panel assemblies extending between one lateral end portion of the front panel member and one lateral end portion of the rear panel member, each of the side panel assemblies being held in abutting contact at its front end with the inner face of the front panel member and at its rear end with the inner face of the rear panel member, adjacent two of the series of block units being spaced apart from each other laterally of the masonry wall structure by a gap defined by one of the side panel assemblies of one of the adjacent two block units and by one of the side panel assemblies of the other of the adjacent two block units, each of the side panel assemblies comprising at least one side panel member of concrete, (d) a plurality of reinforcing bars extending horizontally through the front panel member and having opposite bent end portions projecting rearwardly from opposite end portions, respectively, of the front panel member respectively into the gaps on both sides of the block unit, (e) a plurality of reinforcing bars extending horizontally through the rear panel member and having opposite bent end portions projecting forwardly from opposite end portions, respectively, of the rear panel member respectively into the gaps on both sides of the block unit, (f) a plurality of connecting bars extending horizontally through each of the side panel assemblies and having end portions projecting into each of the gaps on both sides of the block unit forwardly toward the inner face of the front panel member and rearwardly toward the inner face of the rear panel member, wherein each bent end portion of each of the reinforcing bars projecting from the front panel member in part overlaps with the end portion of each of the connecting bars projecting forwardly from each of the side panel assemblies and each bent end portion of each of the reinforcing bars projecting from the rear panel member in part overlaps with the end portion of each of the connecting bars projecting rearwardly from each of the side panel assemblies, (g) binding means by which each bent end portion of each of the reinforcing bars projecting from each of the front and rear panel members is bound to that end portion of each of the connecting bars which is overlapped by the bent end portion, and (h) a body of curable cementitious material filling up each of the gaps for having embedded therein the bent end portions of the reinforcing bars projecting respectively from the front and rear panel members and the end portions of the connecting bars projecting from the side panel assemblies so that the adjacent two of the series of block units are interlocked together along each of the courses of the masonry wall structure. In a masonry wall structure thus constructed and arranged, the binding means may comprise a length of steel wire helically wound round the overlapped end portions of each of the reinforcing bars and each of the connecting bars.

BRIEF DESCRIPTION OF THE DRAWINGS

The features and advantages of a masonry wall structure according to the present invention will be more clearly appreciated from the following description taken in conjunction with the accompanying drawings in which.

DESCRIPTION OF THE PREFERRED EMBODIMENTS

Figure 1:
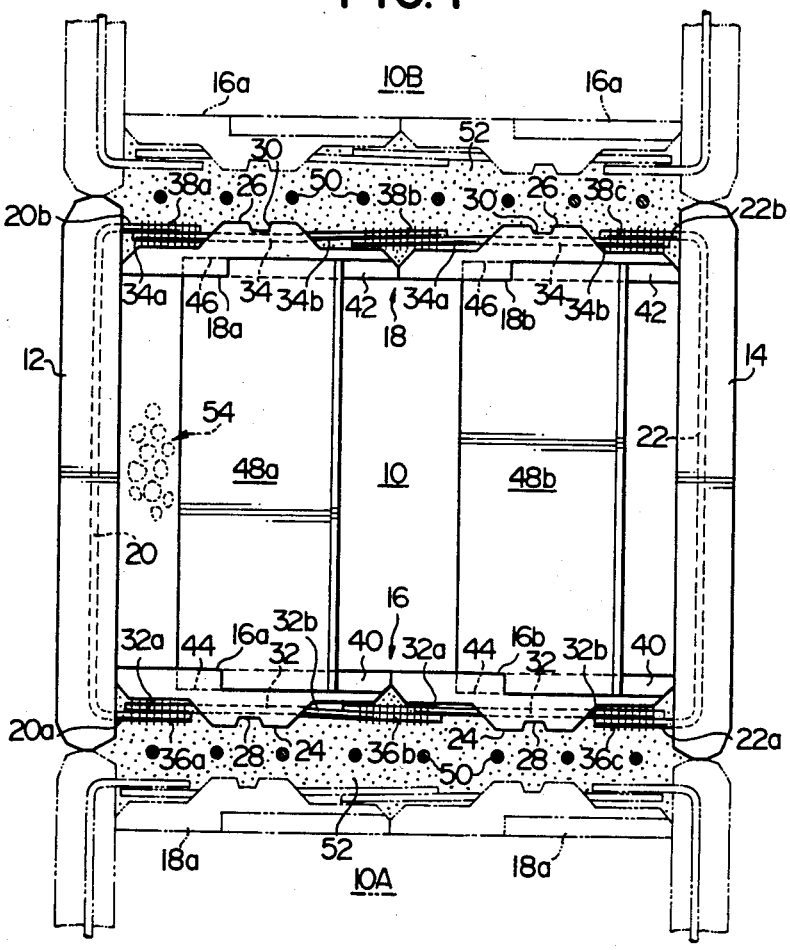
FIG. 1 is a top plan view showing a portion of a masonry wall structure embodying the present invention.

A masonry wall structure to which the present invention appertains is composed of concrete hollow block units laid in a number of "courses" or continuous layers extending throughout the length or horizontal measurement of the wall structure. Each of the courses or layers of the wall structure is composed of a series of concrete block units which are laterally interlocked with one another. The courses of the block units are stacked in tiers so that the individual block units forming each course are interlocked not only laterally with one another but also vertically with the block units forming the immediately overlying and underlying courses, except for the blocks forming the courses at the top and bottom of the wall structure. In FIG. 1 is shown a portion of one of such courses of the masonry wall structure embodying the present invention.

Referring to FIG. 1, each course of the masonry wall structure embodying the present invention is composed of a number of hollow block units, only one of which is shown in its entirety as at 10. The hollow block unit 10 laterally intervenes between and is interlocked to adjacent block units 10A and 10B, only portions of which are herein shown for simplicity of illustration. All the block units forming each of the courses being assumed to be per se similar in configuration, description will be made principally in regard to the construction and arrangement of the block unit 10 in particular.

Figure 2:
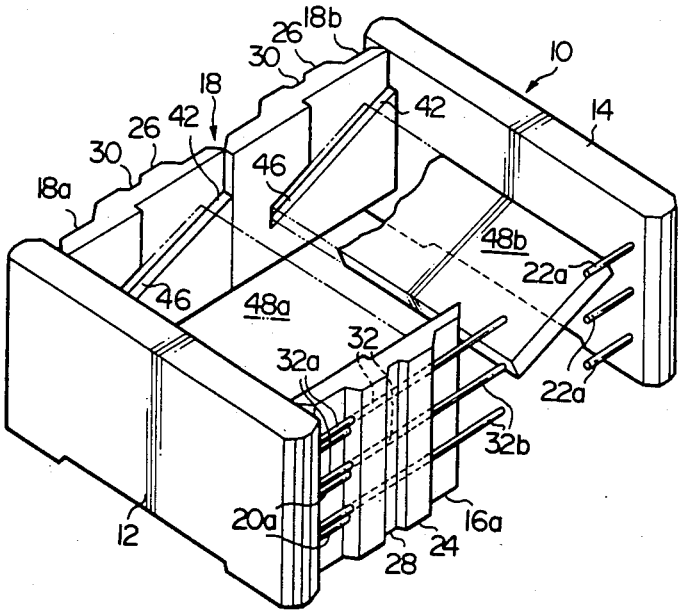
FIG. 2 is a fragmentary perspective view showing portions of a single block unit forming part of the block unit illustrated in FIG. 1.

As shown in FIG. 1 and more concisely in FIG. 2, the block unit 10 largely comprises a front panel member 12, a rear panel member 14 rearwardly spaced apart in parallel from the front panel member 12, and left and right side panel assemblies 16 and 18 spaced apart in parallel from each other laterally of the block unit 10. In the embodiment herein shown, the left side panel assembly 16 is composed of a series combination of two, front and rear side panel members **16*a* and 16*b* and, likewise, the right side panel assembly 18 is composed of a series combination of two, front and rear side panel members 18*a* and 18*b*. The panel members 16*a* and 16*b* forming part of the left side panel assembly 16 are arranged in series between respective left end portions of the front and rear panel members 12 and 14 and, likewise, the panel members 18*a* and 18*b* forming part of the right side panel assembly 18 are arranged in series between respective right end portions of the front and rear panel members 12 and 14 as shown. Each of the front side panel members 16*a* and 18*b* has one end face held in abutting contact with the inner or rear face of the front panel member 12 and, likewise, each of the rear side panel members 16*b* and 18*b* has one end face held in abutting contact with the inner or front face of the rear panel member 14. Furthermore, the two side panel members 16*a*/16*b* or 18*a*/18*b* forming each of the left and right side panel assemblies 16 and 18** have their respective other end faces held in abutting contact with each other.

Each of the front and rear panel members 12 and 14 and side panel members **16*a*, 16*b*, 18*a* and 18*b* thus arranged is constructed of portland cement concrete and has embedded therein a plurality of reinforcing rods or bars of steel some extending horizontally and others extending vertically of the panel member. Thus, the front panel member 12 has embedded therein vertical and horizontal bars including a plurality of reinforcing bars 20 extending horizontally through the panel member 12, as indicated by broken lines in FIG. 1. Similarly, the rear panel member 14 has embedded therein vertical and horizontal bars including a plurality of reinforcing bars 22 extending horizontally through the panel member 14. Each of the reinforcing bars 20 in the front panel member 12 has perpendicularly bent opposite end portions 20*a* and 20*b* projecting rearwardly from opposite end portions, respectively, of the panel member 12 as indicated by full lines in FIG. 1. Likewise, each of the reinforcing bars 22 in the rear panel member 14 has perpendicularly bent opposite end portions 22*a* and 22*b* projecting forwardly from opposite end portions, respectively, of the panel member 14** as also indicated by full lines in FIG. 1.

Each of the side panel members **16*a*, 16*b*, 18*a* and 18*b* has an outwardly protuberant wall portion protruding laterally outwardly of the block unit 10 and extending throughout the height of the panel member. Such a protuberant wall portion of each side panel member is indicated at 24 for each of the panel members 16*a* and 16*b* forming part of the left side panel assembly 16 and at 26 for each of the panel members 18*a* and 18*b* forming part of the right side panel assembly 18. Each of the panel members 16*a* and 16*b* of the left side panel assembly 16 further has a vertical groove 28 formed in the protuberant wall portion 24 and, likewise, each of the panel members 18*a* and 18*b* of the right side panel assembly 18 further has a vertical groove 30 formed in the protuberant wall portion 26. Each of these grooves 28 and 30 also extends throughout the height of the panel member. The protuberant wall portion of each panel member is preferably shaped to have a generally trapezoidal horizontal cross section with the smaller outer parallel side of the trapezoid partly recessed in the presence of the groove 28 or 30**.

Each of the panel members **16*a* and 16*b* forming part of the left side panel assembly 16 has a plurality of connecting bars 32 extending throught the protuberant wall portion 24 of the panel member 16*a* /16*b* longitudinally of the panel member, viz., between the front and rear panel members 12 and 14. Each of these connecting bars 32 has opposite, front and rear end portions 32*a* and 32*b* projecting forwardly and rearwardly, respectively, from the protuberant wall portion 24 of the panel member 16*a*/16*b*. Similarly, each of the panel members 18*a* and 18*b* forming part of the right side panel assembly 18 has a plurality of connecting bars 34 extending through the protuberant wall portion 26 of the panel member 18*a*/18*b* between the front and rear panel members 12 and 14. Each of the connecting bars 34 of the panel members 18*a* and 18*b* also has opposite, front and rear end portions 34*a* and 34*b* projecting forwardly and rearwardly, respectively, from the protuberant wall portion 26 of the panel member 18*a*/18*b*. As will be understood from FIG. 2, the connecting bars 32 on each of the left side panel members 16*a* and 16*b* are vertically spaced from each other and, likewise, the connecting bars 34 on each of the right side panel members 18*a* and 18*b*** are vertically spaced from each other.

The front end portions **32*a* of the connecting bars 32 projecting from the front left side panel member 16*a*** terminate adjacent the inner or rear face of the front panel member 12 and closely overlap with the bent end portions 20*a* of the reinforcing bars 20 projecting rearwardly from the panel member 12. Similarly, the front end portions 34*a* of the connecting bars 34 projecting from the front right side panel member 18*a* terminate adjacent the inner or rear face of the front panel member 12 and closely overlap with the bent end portions 20*b* of the reinforcing bars 20 projecting rearwardly from the panel member 12. Furthermore, the rear end portions 32*b* of the connecting bars 32 projecting from the front left side panel member 16*a* extend toward the protuberant wall portion 24 of the rear left side panel member 16*b* and the front end portions 32*a* of the connecting bars 32 projecting from the rear left side panel member 16*b* extend toward the protuberant wall portion 24 of the front left side panel member 16*a*. These rear end portions 32*b* of the connecting bars 32 projecting from the front left side panel member 16*a* closely overlap with the front end portions 32*a* of the connecting bars 32 projecting from the rear left side panel member 16*b*. Similarly, the rear end portions 34*b* of the connecting bars 34 projecting from the front right side panel member 18*a* extend toward the protuberant wall portion 26 of the rear right side panel member 18*b* and the front end portions 34*a* of the connecting bars 34 projecting from the rear right side panel member 18*b* extend toward the protuberant wall portion 26 of the front right side panel member 18*a*. These rear end portions 34*b* of the connecting bars 34 projecting from the front right side panel member 18*a* closely overlap with the front end portions 34*a* of the connecting bars 34 projecting from the rear right side panel member 18*b*. On the other hand, the rear end portions 32*b* of the connecting bars 32 projecting from the rear left side panel member 16*b* terminate adjacent the inner or front face of the rear panel member 14 and closely overlap with the bent end portions 22*a* of the reinforcing bars 22 projecting forwardly from the panel member 14. Similarly, the rear end portions 34*b* of the connecting bars 34 projecting from the rear right side panel member 18*b* terminate adjacent the inner or front face of the rear panel member 14 and closely overlap with the bent end portions 22*b* of the reinforcing bars 22 projecting forwardly from the panel member 14. While it will be seen from FIG. 1 that the overlap between the individual connecting and reinforcing bars occur horizontally, such is simply for convenience of illustration and, thus, the overlap between the connecting and reinforcing bars provided in the block unit may occur vertically or otherwise.

The bent end portions 20*a* of the reinforcing bars 20 projecting from the front panel member 12 are spliced or bound to the front end portions 32*a* of the connecting bars 32 projecting from the front left side panel member 16*a* by means of a steel wire 36*a* which is helically wound round the portions 32*a* and 20*a* overlapping with each other. Likewise, the rear end portions 32*b* of these connecting bars 32 are spliced or bound to the front end portions 32*a* of the connecting bars 32 projecting from the rear left side panel member 16*b* by means of a steel wire 36*b* which is helically wound round the portions 32*b* and 32*a* overlapping with each other. Furthermore, the rear end portions 32*b* of the connecting bars 32 projecting from the rear left side panel member 16*b* are spliced or bound to the bent end portions 22*a* of the reinforcing bars 22 projecting from the rear panel member 14 by means of a steel wire 36*c* which is helically wound round the portions 32*b* and 22*a* overlapping each other. Similarly, the bent end portions 20*b* of the reinforcing bars 20 projecting from the front panel member 12 are spliced or bound to the front end portions 34*a* of the connecting bars 34 projecting from the front right side panel member 18*a* by means of a steel wire 38*a* which is helically wound round the portions 34*a* and 20*b* overlapping each other. The rear end portions 34*b* of these connecting bars 34 are spliced or bound to the front end portions 34*a* of the connecting bars 34 projecting from the rear right side panel member 18*b* by means of a steel wire 38*b* which is helically wound round the portions 34*b* and 34*a* overlapping each other. Furthermore, the rear end portions 34*b* of the connecting bars 34 projecting from the rear right side panel member 18*b* are spliced or bound to the bent end portions 22*b* of the reinforcing bars 22 projecting from the rear panel member 14 by means of a steel wire 36*c* which is helically wound round the portions 34*b* and 22*b* overlapping each other.

While the reinforcing bars 20 and 22 and connecting bars 32 and 34 are thus assumed to be spliced or bound together by means of steel wires which form simple lap joints, these bars may be tied together by welding to form welded lap joints or by rivetting to form rivetted lap joints though not shown in the drawings. Furthermore, each of the end portions of the bars 20, 22, 32 and 34 to be joined together may if desired be turned back or hooked at its extreme end, though not shown in the drawings.

Each of the panel members 16*a* and 16*b* forming part of the left side panel assembly 16 has on its inner side a ledge portion having an upper ramp surface portion 40 slanting downwardly from the rearmost end of the panel member 16*a* /16*b* and terminating short of the foremost end of the panel member 16*a*/16*b*. Likewise, each of the panel members 18*a* and 18*b* forming part of the right side panel assembly 18 has on its inner side a ledge portion having an upper ramp surface portion 42 slanting downwardly from the rearmost end of the panel member 18*a*/18*b* and terminating short of the foremost end of the panel member 18*a*/18*b*. The ramp surface portion 40 of each panel member 16*a*/16*b* has a front end portion defining the bottom surface of a groove 44 which is also inclined downwardly toward and terminating short of the foremost end of the panel member 16*a* /16*b*. Similarly, the ramp surface portion 42 of each panel member 18*a* /18*b* has a front end portion defining the bottom surface of a groove 46 which is inclined downwardly toward and terminating short of the foremost end of the panel member 18*a*/18*b*. The remaining portions of the ramp surface portions 40 and 42 are open upwardly as will be better seen from FIG. 2. The ramp surface portions 40 of the left side panel members 16*a* and 16*b* are respectively aligned with the ramp surface portions 42 of the right side panel members 18*a* and 18*b* which are respectively spaced apart from the panel members 16*a* and 16*b* laterally of the block unit 10. It may be noted that a preferred angle of inclination of the ramp surface portions 40 and 42 is about 30 degrees to the horizontal.

A front cross plate 48*a* is received along its opposite side edges on the aligned ramp surface portions 40 and 42 of the two left and right side panel members 16*a* and 18*a* and, likewise, a rear cross plate 48*b* is received along its opposite side edges on the aligned ramp surface portions 40 and 42 of the two left and right side panel members 16*b* and 18*b*. Each of these front and rear cross plates 48*a* and 48*b* has its front end portion received in the grooves 44 and 46 in the side panel members 16*a* and 18*a* or the side panel members 16*b* and 18*b* along the lateral edges of the front end portion and are inclined downwardly along the ramp surface portions 40 and 42 of the panel members. Each of the cross plates 48*a* and 48*b* is also constructed of portland cement concrete and has embedded therein a plurality of reinforcing bars some extending laterally between the side ends of the plate and others extending between the front and rear ends of the plate, though not shown in the drawings.

As will be seen from FIG. 1, each of the block units of each course of the wall structure has one of its two side panel assemblies 16 and 18 positioned close to and spaced apart from one of the side panel assemblies of the adjacent block unit. Between adjacent two of the block units of each course is thus formed a gap which is defined between one side panel assembly of one block unit and one side panel assembly of the other block unit. The gap extends vertically throughout the height of the adjacent block units or of the course including the adjacent block units and horizontally between the front and rear panel members 12 and 14 of the two block units. In FIG. 1 are seen two of such gaps, one formed between the block units 10 and 10A and the other formed between the block units 10 and 10B. The gap between the block units 10 and 10A is defined between the left side panel assembly 16 of the block unit 10 and the right side panel assembly 18 of the block unit 10A while the gap between the block units 10 and 10B is defined between the right side panel assembly 18 of the block unit 10 and the left side panel assembly 16 of the block unit 10B.

Within each of the gaps thus formed between the adjacent block units 10/10A or 10/10B is provided a series of vertical reinforcing bars 50 which are located at regular intervals between the front and rear ends of the gap. These vertical reinforcing bars 50 are arranged to have their respective center axes on a vertical center plane between the adjacent block units 10/10A or 10/10B and longitudinally extend at least throughout the height of the block units or of the course. Where the regular masonry bond is used with no overlapping of block units between alternate courses, the reinforcing bars 50 may be arranged to extend through the vertically aligned gaps between the block units of two or more adjacent courses, though not shown in the drawings. The reinforcing bars 50 thus extending through each of the gaps between the adjacent block units 10, 10A and 10B are embedded in a body of mortar 52 or other time-curable cementitious material such as cement or concrete poured into and completely filling up the gap. The overlapping end portions of the reinforcing and connecting bars 12, 14, 32 and 34 spliced by the steel wires 36*a* to 36*c* and 38*a* to 36*c* are thus completely buried in and as a consequence firmly interlocked together by means of the body of mortar 52 which has the particular portions of the bars closely wrapped or embedded therein when the mortar poured is completely cured. The grooves 28 and 30 provided in the protuberant wall portions 24 and 26, respectively, of the side panel members 16*a*, 16*b*, 18*a* and 18*b* as previously mentioned are useful for adding to the bond or cohesion between the panel members and the mortar 52. The grooves 28 and 30 provided for such a purpose may be substituted by ribs formed on the outer faces of the protuberant wall portions 24 and 26 and vertically extending throughout the height of the side panel members, though not shown in the drawings.

The masonry wall structure built by the hollow block units each of which is constructed as hereinbefore described is erected on a suitable subsurface foundation or footing with its face vertical or buttered, though not shown in the drawings. The individual block units forming such a masonry wall structure are filled with earth as symbolically indicated at 54 in FIG. 1 possibly except for those block units which form a subsurface base portion of the wall structure. The block units thus forming the subsurface base portion of the wall structure may be filled with concrete to provide added stability of the wall structure cantilevered by the subsurface foundation or footing. In each of the above-ground block units filled with earth as at 54, the inclined cross plates 48*a* and 48*b* are embedded in the earth thus filling the block unit and serve not only as buried cross beams but advantageously also as lifting means which impart upward forces to the wall structure in response to the earth pressure which horizontally acts on the plates.

Figure 3:
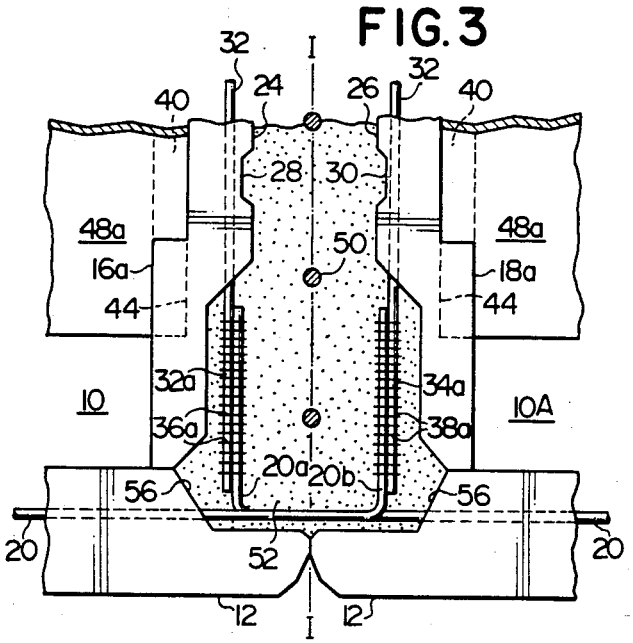
FIG. 3 is a fragmentary top plan view showing part of a modification of the masonry wall structure partially illustrated in FIG. 1.

FIG. 3 shows a portion of a modification of the masonry wall structure hereinbefore described with reference to FIGS. 1 and 2. In the embodiment herein shown, each of the front and rear panel members such as the front panel member 12 as shown of each of the block units such as the block units 10 and 10A as shown has a recess 56 formed in each of its opposite lateral end portions. The recess 56 thus provided in each of the lateral end portions of the front panel member 12 forms part of the gap between the two block units 10 and 10A. Each of the reinforcing bars 20 extending through the front panel member 12 projects into this recess 56 in the panel member 12 horizontally along the lateral end portion of the panel member. Furthermore, each reinforcing bar 20 extends from the recess 56 in the front panel member 12 of one block unit 10 into the recess 56 in the front panel member 12 of the adjacent block unit 10A before the bar 20 merges into the perpendicularly bent end portion 20*a* or 29*b* of the bar 20. Thus, each of the reinforcing bars 20 extends across the vertical center plane H—H between the adjacent block units 10/10A or 10/10B as shown and past the center plane H-H merges into the bent end portion 20*a* or 29*b* of the reinforcing bar 20. Each of the reinforcing bars 22 projecting from the rear panel member 14 is arranged similarly to the reinforcing bar 20, though not shown in the drawings. In the wall structure thus arranged, each of the reinforcing bars 20 and 22 projecting from the front and rear panels 12 and 14, respectively, is allowed to extend an increased distance through the body of mortar 52 and to stick the body of mortar 52 with an increased force, thus adding to the force with which the adjacent block units are interlocked together through and by the body of mortar 52.

Figure 4A:
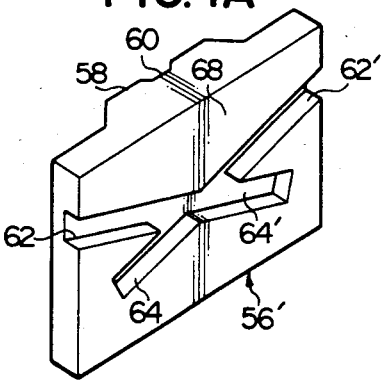
FIGS. 4A and 4B are perspective views each showing an improved form of side panel member forming part of each of the side panel assemblies of the block unit shown in FIG. 1.
Figure 4B:
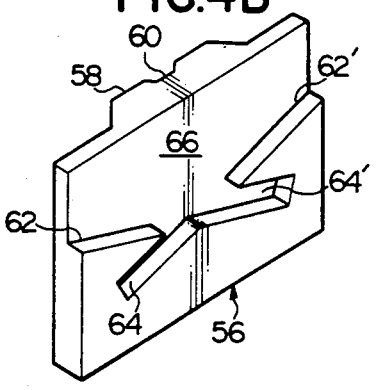

As discussed at the outset of the description, the side panel members forming part of a prior-art hollow built-up concrete block unit using bolts and nuts for joining the panels to the front and rear panels must be formed with cutouts or recesses to provide spaces for accommodating the bolts and nuts. The panel members forming part of the side panel assemblies of a masonry wall structure according to the present invention need not be formed with such cutouts or recesses. This provides ease and increased freedom in designing the side panels and make it possible to construct a side panel so that the panel member is substantially symmetric with respect to the vertical center plane which the side panel member has between the front and rear ends thereof. FIGS. 4A and 4B showing examples of such a side panel member.

The side panel member, designated by 56', has two pairs groove portions consisting of a pair of grooves respectively having bottom ramp surface portions 62 and 62' and a pair of grooves respectively having bottom ramp surface portions 64 and 64'. The ramp surface portion 62 of one pair of grooves and the ramp surface portion 64' of the other pair of grooves occur on a common plane inclined downwardly from one longitudinal end of the panel member 56' toward the other. Likewise, the ramp surface portion 62' of the one pair of grooves and the ramp surface portion 64 of the other pair of grooves occur on a common plane inclined downwardly from the other longitudinal end of the panel member 56' toward the one longitudinal end of the panel member 56'. Thus, the ramp surface portions 62 and 64' on one common inclined plane form are intersected generally in the form of the letter "X" by the ramp surface portions 62' and 64 on the other common inclined plane. The intersection between the two common planes occurs on the vertical center plane which the side panel member 56' has between the longitudinal ends of the panel member. While the panel member 56' thus formed with two pairs of grooves has not only the lower ledge portion but an upper ledge portion 68, such an upper ledge portion 68 may be removed as indicated at 66 in FIG. 4B. In the side panel member, now designated by numeral 56, shown in FIG. 4B, there is a single pair of grooves having bottom ramp surface portions 64 and 64' with a pair of ramp surface portions 64 and 64' formed to be open upwardly.

The side panel assemblies 16 and 18 of the block unit forming part of the masonry wall structure embodying the present invention has been shown and described as being such that each of the panel assemblies has a pair of panel members. This is however simply by way of example and, therefore, the side panel assembly of each of the concrete block units of a wall structure according to the present invention may be composed of a single panel member or a series of three or panel members and a plurality of connecting rods or bars projecting from the panel member or members.

What is claimed is:

1. A masonry wall structure comprising a number of block units laid in courses each composed of a series of block units positioned laterally adjacent to one another, wherein each of the block units comprises (a) a front panel member of concrete, (b) a rear panel member of concrete rearwardly spaced apart substantially in parallel from the front panel member, (c) a pair of side panel assemblies spaced apart substantially in parallel from each other laterally of the block unit, one of the side panel assemblies extending between one lateral end portion of the front panel member and one lateral end portion of the rear panel member, each of the side panel assemblies being held in abutting contact at its front end with the inner face of the front panel member and at its rear end with the inner face of the rear panel member, adjacent two of said series of block units being spaced apart from each other laterally of the masonry wall structure by a gap defined by one of the side panel assemblies of one of the adjacent two block units and by one of the side panel assemblies of the other of the adjacent two block units, each of said side panel assemblies comprising at least one side panel member of concrete, (d) a plurality of reinforcing bars extending horizontally through said front panel member and having opposite bent end portions projecting rearwardly from opposite end portions, respectively, of the front panel member respectively into the gaps on both sides of the block unit, (e) a plurality of reinforcing bars extending horizontally through said rear panel member and having opposite bent end portions projecting forwardly from opposite end portions, respectively, of the rear panel member respectively into the gaps on both sides of the block unit, (f) a plurality of connecting bars extending horizontally through each of said side panel assemblies and having end portions projecting into each of the gaps on both sides of the block unit forwardly toward the inner face of the front panel member and rearwardly toward the inner face of the rear panel member, wherein each bent end portion of each of the reinforcing bars projecting from the front panel member in part overlaps with the end portion of each of the connecting bars projecting forwardly from each of said side panel assemblies and each bent end portion of each of the reinforcing bars projecting from the rear panel member in part overlaps with the end portion of each of the connecting bars projecting rearwardly from each of said side panel assemblies, (g) binding means by which each bent end portion of each of the reinforcing bars projecting from each of the front and rear panel members is bound to that end portion of each of the connecting bars which is overlapped by the bent end portion, and (h) a body of curable cementitious material filling up each of said gaps for having embedded therein said bent end portions of the reinforcing bars projecting respectively from said front and rear panel members and said end portions of said connecting bars projecting from said side panel assemblies so that the adjacent two of said series of block units are interlocked together along each of said courses of the masonry wall structure.

2. A masonry wall structure as set forth in claim 1, in which said binding means comprising a length of steel wire helically wound round the overlapped end portions of each of said reinforcing bars and each of said connecting bars.

3. A masonry wall structure as set forth in claim 1 or 2, in which each of said side panel assemblies has on its inner side at least one ledge portion having an upper ramp surface portion slanting downwardly toward said front panel member, the ramp surface portion of each of the side panel assemblies having a front end portion defining the bottom surface of a groove which is inclined downwardly toward the front panel member, said masonry wall structure further comprising at least one cross plate of concrete having one side edge received on the ramp surface portion of one of said side panel assemblies and an opposite side edge received on the ramp surface portion of the other of said side panel assemblies, said cross plate having its front end portion, received in the grooves in the side panel assemblies and being inclined downwardly along the ramp surface portions of the side panel assemblies.

4. A masonry wall structure as set forth in claim 3, in which said side panel member which forms at least part of each of said side panel assemblies is substantially symmetric with respect to the vertical center plane which the side panel member has between the front and rear ends thereof.

5. A masonry wall structure as set forth in claim 3, in which each of said front and rear panel members of each of said series of block units has in each of its opposite lateral end portions a recess forming part of the gap on each side of the block unit, each of the reinforcing bars respectively extending through said front and rear panel members projects into said recess horizontally along the lateral end portion of each of the front and rear panel members and extends from the recess in each of the front and rear panel members of one block unit into the recess in each of the front and rear panel members of the adjacent block unit before merging into the bent end portion thereof.

* * * * *